US008209886B2

(12) United States Patent
Hurd et al.

(10) Patent No.: US 8,209,886 B2
(45) **Date of Patent: *Jul. 3, 2012**

(54) ENGAGING ELEMENT USEFUL FOR SECURING OBJECTS, SUCH AS FOOTWEAR AND OTHER FOOT-RECEIVING DEVICES

(75) Inventors: John Hurd, Tigard, OR (US); Thomas C. Foxen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 102 days.

This patent is subject to a terminal disclaimer.

(21) Appl. No.: 12/795,160

(22) Filed: Jun. 7, 2010

(65) Prior Publication Data

US 2010/0236099 A1 Sep. 23, 2010

Related U.S. Application Data

(63) Continuation of application No. 11/677,034, filed on Feb. 20, 2007, now Pat. No. 7,730,639, which is a continuation of application No. 10/691,027, filed on Oct. 21, 2003, now Pat. No. 7,178,270.

(51) Int. Cl.
*A43B 11/00* (2006.01)

(52) U.S. Cl. ..... 36/92; 36/58.5; 36/27; 36/138

(58) Field of Classification Search ..... 36/92, 58.5, 36/27, 138, 58.6, 77 R See application file for complete search history.

(56) References Cited

U.S. PATENT DOCUMENTS 558,937 A * 4/1896 Edmonds ..... 36/58.6
808,948 A * 1/1906 Roberts ..... 36/58.5
1,686,175 A * 10/1928 Read ..... 36/58.5
2,069,752 A * 2/1937 Dorr ..... 36/11.5
2,452,649 A * 11/1948 Graves ..... 36/138
2,693,039 A * 11/1954 Balut ..... 36/58.5

(Continued)

FOREIGN PATENT DOCUMENTS

EP 1 059 044 A 12/2000

(Continued)

OTHER PUBLICATIONS

International Search Report issued in related PCT Application, International Application No. PCT/US2004/033127, on Dec. 9, 2004.

*Primary Examiner* — Marie Patterson
(74) *Attorney, Agent, or Firm* — Banner & Witcoff, Ltd.

(57) ABSTRACT

Engaging elements may be included in foot-receiving devices, such as footwear, bindings, clips, or the like. Such elements may include a bimodal spring member movable between two independent stable positions and an arm that moves in response to the bimodal spring member changing between its stable positions. The engaging elements additionally may include a retaining element extending from the arm and/or an arm/bimodal spring interface that induces changes in position of the arm in response to the bimodal spring member changing its stable position. The bimodal spring member, the arm, the retaining element, and/or the arm/bimodal spring interface may form an integral unit. Additionally, methods of engaging a foot-receiving device with a user's foot are disclosed. Such methods may include: (a) orienting a bimodal spring member in a first stable position to place a foot-engaging portion of the foot-receiving device in a foot-accepting position, and (b) moving the bimodal spring member from the first stable position to a second stable position to move the foot-engaging portion of the foot-receiving device to a foot-engaging position.

25 Claims, 13 Drawing Sheets

U.S. PATENT DOCUMENTS

| | | | | |
|---|---|---|---|---|
| 2,746,178 | A * | 5/1956 | Miller et al. | 36/58.5 |
| 3,039,207 | A * | 6/1962 | Lincors | 36/58.5 |
| 3,146,535 | A * | 9/1964 | Owings | 36/7.3 |
| 3,400,474 | A * | 9/1968 | Tendler | 36/58.5 |
| 3,436,842 | A * | 4/1969 | Maxwell | 36/97 |
| 5,054,216 | A * | 10/1991 | Lin | 36/138 |
| 5,282,327 | A * | 2/1994 | Ogle | 36/138 |
| 5,481,814 | A * | 1/1996 | Spencer | 36/138 |
| 6,298,582 | B1 * | 10/2001 | Friton et al. | 36/88 |
| 7,178,270 | B2 * | 2/2007 | Hurd et al. | 36/92 |
| 7,730,639 | B2 * | 6/2010 | Hurd et al. | 36/92 |
| 2002/0174568 | A1 * | 11/2002 | Neiley | 36/50.1 |
| 2003/0009916 | A1 * | 1/2003 | Bernstein | 36/50.1 |
| 2003/0009917 | A1 * | 1/2003 | Voswinkel | 36/50.1 |

FOREIGN PATENT DOCUMENTS

| | | | |
|---|---|---|---|
| WO | 03/039283 | A | 5/2003 |

* cited by examiner

ENGAGING ELEMENT USEFUL FOR SECURING OBJECTS, SUCH AS FOOTWEAR AND OTHER FOOT-RECEIVING DEVICES

RELATED APPLICATION DATA

This application is a continuation of U.S. patent application Ser. No. 11/677,034, filed Feb. 20, 2007 in the name of John Hurd, et al., and entitled "Engaging Element Useful for Securing Objects, such as Footwear and Other Foot-Receiving Devices," now U.S. Pat. No. 7,730,639, which application is a continuation of U.S. patent application Ser. No. 10/691,027, filed Oct. 21, 2003 in the name of John Hurd, et al., and entitled "Engaging Element Useful for Securing Objects, such as Footwear and Other Foot-Receiving Devices," now U.S. Pat. No. 7,178,270. These priority applications are entirely incorporated herein by reference.

FIELD OF THE INVENTION

The present invention relates generally to elements for engaging or securing two or more members together. In one more specific example, the engaging elements may be used, for example, for engaging or securing a foot in a foot-receiving device, such as footwear, bindings, clips, or other devices.

BACKGROUND

Conventional footwear typically attaches to a user's foot via laces, buckles, straps, hook and loop fasteners, elastic bands, zippers, and the like. While effective, these types of foot-engaging elements can be difficult for some to utilize. For example, some users can have difficulty tying shoelaces, e.g., because of a lack of finger dexterity, arthritis or other conditions, or the like. Additionally, some users can have difficulty operating the small mechanisms typically associated with buckles and zippers used on shoes.

Other problems can exist in the use of conventional shoe attachment devices like those described above. For example, when shoelaces, straps, buckles, elastic bands, zippers, and the like are not sufficiently loose or opened, it can be difficult for the user to insert his or her foot into the shoe. Additionally, these attachment devices can inadvertently loosen while in use, resulting in safety hazards for users, e.g., from tripping, unexpected shoe loss, etc.

Additionally, conventional shoe attachment devices like those described above are dramatically visible in the final footwear product. To some, shoelaces, straps, buckles, and zippers are not aesthetically pleasing, at least in some desired shoe designs. Hook and loop fasteners tend to collect threads and other debris, which can detract from the appearance of the shoe. Moreover, the need to use these conventional shoe attachment devices can limit the creativity of designers in producing new footwear product designs.

Accordingly, it would be advantageous to provide an alternative engaging device that is easy and quick to use and that could securely hold or engage two or more members together. Additionally, in some more specific examples, it would be advantageous to provide an alternative foot-engaging device (e.g., a foot attachment system) that is quick and easy to use and that can securely hold or engage a foot in a foot-receiving device (such as footwear, bindings, clips, and the like), and optionally, that could be used both with and without conventional attachment devices. Additionally, in at least some instances, it would be advantageous to provide a foot-engaging device that was not visible or less visibly apparent during use than many conventional foot attachment systems, to allow designers more freedom in designing the exterior appearance of footwear.

SUMMARY

Aspects of the present invention relate to engaging elements, such as elements for engaging a foot that may be included in foot-receiving devices, such as footwear, bindings (e.g., for skis, snowboards, etc.), clips or other devices for receiving feet (e.g., in pedals, games, exercise equipment, video games, etc.), and the like. Such elements may include a bimodal spring member movable between a first stable position and a second stable position, and an arm extending from the bimodal spring member, wherein the arm moves in response to the bimodal spring member changing between the first stable position and the second stable position (and vice versa). These elements additionally may include retaining elements, such as foot-retaining elements, extending from the arm and/or an arm/bimodal spring interface that induces changes in position of the arm in response to the bimodal spring member changing between the first stable position and the second stable position (and vice versa). In some examples, at least some of the bimodal spring member, the arm, the retaining element, and/or the arm/bimodal spring interface may form an integral unit.

Additionally, aspects of this invention relate to pieces of footwear or other foot-receiving devices that include an engaging element for attaching the foot-receiving device to a foot including one or more of the elements described above.

Still other aspects of this invention relate to methods of engaging a foot-receiving device with a user's foot, e.g., using elements for engaging a foot like those described above. Such methods may include: (a) orienting a bimodal spring member in a first stable position to place a foot-engaging portion of the foot-receiving device in a foot-accepting position, and (b) moving the bimodal spring member from the first stable position to a second stable position to thereby move the foot-engaging portion of the foot-receiving device to a foot-engaging position.

BRIEF DESCRIPTION OF THE DRAWINGS

The above and other objects, features, and advantages of the present invention will be readily apparent and fully understood from the following detailed description, taken in connection with the appended drawings, in which.

DETAILED DESCRIPTION

Figure 1A:
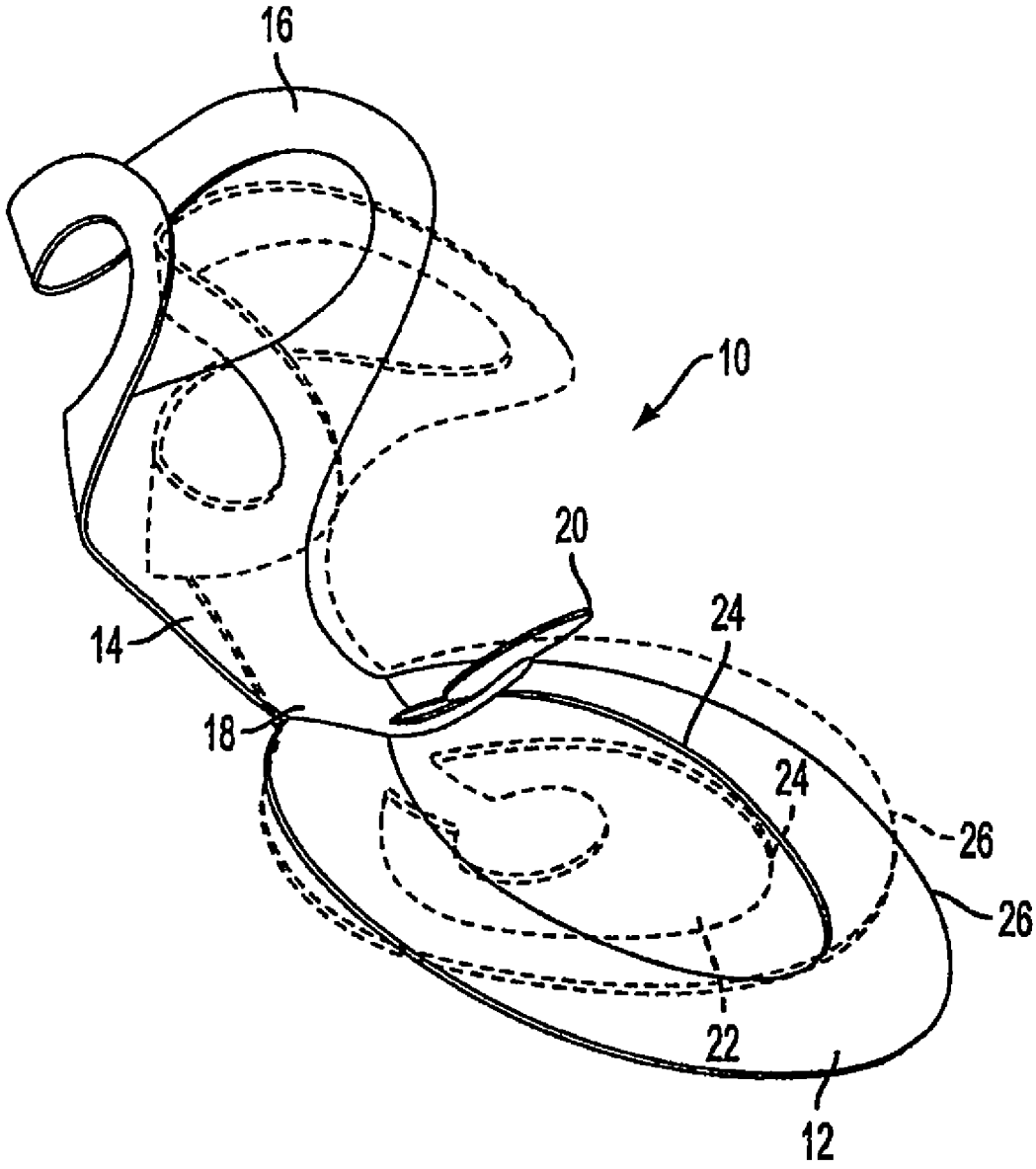
FIGS. 1A and 1B illustrate an example engaging device that engages a heel portion of a user's foot when placed in a foot-receiving device.

Various specific examples of the invention are described in detail below in conjunction with the attached drawings. To assist the reader, this specification is broken into various subsections, as follows: Terms; General Description of an Engaging Element; Specific Examples of the Invention; and Conclusion.

A. Terms

The following terms are used in this specification, and unless otherwise noted or clear from the context, these terms have the meanings provided below.

"Foot-receiving device" means any device into which a user places at least some portion of his or her foot. In addition to all types of footwear, foot-receiving devices include, but are not limited to: bindings and other devices for securing feet in snow skis, cross country skis, water skis, snowboards, and the like; bindings, clips, or other devices for securing feet in pedals for use with bicycles, exercise bikes, games, and the like; bindings, clips, or other devices for receiving feet during play of video games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, ski boots, etc.), and the like.

"Foot-engaging device" or "foot-engaging element" are used interchangeably in this specification and mean a device or element that, in some manner, engages a foot or a portion of a foot to, at least in part, maintain relative positioning of a foot in a foot-receiving device. "Foot-engaging devices" (or elements) may actually help secure or attach a foot-receiving device (or a portion of a foot-receiving device) to a foot and/or they may prevent or hinder movement of the foot-receiving device in one or more directions with respect to the foot. "Foot-engaging devices" may engage any portion of a foot, including, but not limited to, the ankle, the heel, the lateral sides, and one or more toes.

"Bimodal spring member" means a device that has at least two independent minimal or low stress state positions at which the device can maintain a stable structure. An external force applied to the device may move it from one minimal or low stress state position to another. In at least some examples, no external forces are needed to hold the bimodal spring member in its various stable positions.

B. General Description of an Engaging Element

In general, aspects of this invention relate to engaging elements, such as elements for engaging a foot that may be included in foot-receiving devices, such as footwear, bindings (e.g., for skis, snowboards, etc.), clips, or other devices for receiving feet (e.g., in pedals, games, exercise equipment, video games, etc.), and the like. Engaging elements in accordance with at least some examples of this invention may include a bimodal spring member movable between a first stable position and a second stable position, and an arm extending from the bimodal spring member, wherein the arm moves in response to the bimodal spring member changing between the first stable position and the second stable position.

The bimodal spring member and arm may take on many forms or shapes without departing from the invention. For example, in some instances the bimodal spring member may be round or oval shaped, optionally with an opening defined therein, to allow the spring to switch between at least two stable positions. If desired, a "bimodal spring member" as used in this specification may be movable between more than two stable positions without departing from the invention. Likewise, an engaging element according to at least some examples of this invention may include more than one arm extending from the bimodal spring member.

In addition, in at least some examples of the invention, the engaging element additionally may include a retaining element, such as a foot-retaining element, extending from the arm and/or an arm/bimodal spring interface that induces changes in a position of the arm in response to the bimodal spring member changing between the first stable position and the second stable position. Additionally, the arm/bimodal spring interface also may induce changes in the orientation of the bimodal spring member (e.g., from the first stable position to the second stable position and vice versa) in response to movement of the arm. In some instances, at least some of the bimodal spring member, the arm, the retaining element, and/or the arm/bimodal spring interface may form an integral unit.

When present, the retaining element according to at least some examples of the invention may engage and/or retain any object(s), and it may come in a variety of different configurations. As an example, the retaining element may engage and/or retain any portion of the foot. For example, the retaining element may be shaped so as to define a heel-capturing member or cup that engages the heel or ankle area of a user. As another example, the retaining element, when present, may define an area for retaining a user's toes. Retaining elements also may be designed to engage along a lateral side area of the foot without departing from the invention.

The arm/bimodal spring interface present in at least some examples of this invention also may take on many forms or shapes without departing from the invention. As one example, the interface may constitute a portion of an overall integral structure that assists in translating movement of the bimodal spring to movement of the arm and vice versa. For example, the arm/bimodal spring interface may constitute a portion of the bimodal spring located at the position where the arm extends from the spring. As another example, a first end portion of the arm/bimodal spring interface may extend into and/or through an opening defined in the bimodal spring member when the bimodal spring member is in the first stable position. This first end portion of the interface will not necessarily extend through and/or above the opening when the bimodal spring member is in its second stable position, in at least some examples of the invention. Additionally, in some examples of the invention, a second end portion of the interface may extend away from the bimodal spring member along with (and integrally form at least a portion of) the arm, to support and reinforce the arm.

In some examples of the invention, changing the bimodal spring member between its stable positions can allow a user to place his or her foot in a foot-receiving device. For example, in some instances, when the bimodal spring member is in the first stable position, the arm is in a foot-receiving position, and when the bimodal spring member changes to its second stable position, the arm changes to a foot-engaging position.

Additional aspects of this invention relate to pieces of footwear or other foot-receiving devices that include a shoe member (or other foot-receiving device) and an engaging element attached to the shoe member. The engaging element may include one or more elements for engaging a foot, like the elements described above. The engaging element(s) may be located at any desired portion of the shoe member without departing from the invention. For example, in some instances the engaging element may be located at a heel portion of the shoe member, and/or in some instances the engaging element may be located at a toe portion of the shoe member, and/or in still other instances the engaging element may be located along a lateral side portion of the shoe member. Additionally, if desired, in at least some examples of the invention, the engaging element may be used to connect various portions of the shoe or other foot-receiving devices together. For instance, the engaging element, at least in part, may connect a midsole of the shoe member to a footbed (or insole) of the shoe member, and/or the engaging element, at least in part, may connect an outsole of the shoe member to a midsole of the shoe member.

Still other aspects of this invention relate to methods of engaging an engaging device to another member. Such methods may include: orienting a bimodal spring member in a first stable position to place an engaging portion of the engaging device in an open position; and moving the bimodal spring member from the first stable position to a second stable position to thereby move the engaging portion of the engaging device to a closed position. Optionally, methods in accordance with this invention may include methods of engaging a foot-receiving device with a user's foot. Such methods may include: (a) orienting a bimodal spring member in a first stable position to place a foot-engaging portion of the foot-receiving device in a foot-accepting position, and (b) moving the bimodal spring member from the first stable position to a second stable position to thereby move the foot-engaging portion of the foot-receiving device to a foot-engaging position. As described above, the foot-engaging portion of the foot-receiving device may engage any portion of the user's foot when in the foot-engaging position (e.g., it may engage a user's heel, a user's toes, the lateral sides of the user's foot, etc.). Also, in at least some examples of the invention, the bimodal spring member may be moved from the first stable position to the second stable position by a user's foot, e.g., it may automatically change positions as the user applies pressure when placing his or her foot into the foot-receiving device.

Specific examples of the invention are described in more detail below. The reader should understand that these specific examples are set forth merely to illustrate examples of the invention, and they should not be construed as limiting the invention.

C. Specific Examples of the Invention

The various figures in this application illustrate examples of engaging devices according to this invention and their use. When the same reference number appears in more than one drawing, that reference number is used consistently in this specification and the drawings to refer to the same part throughout.

Figure 1B:
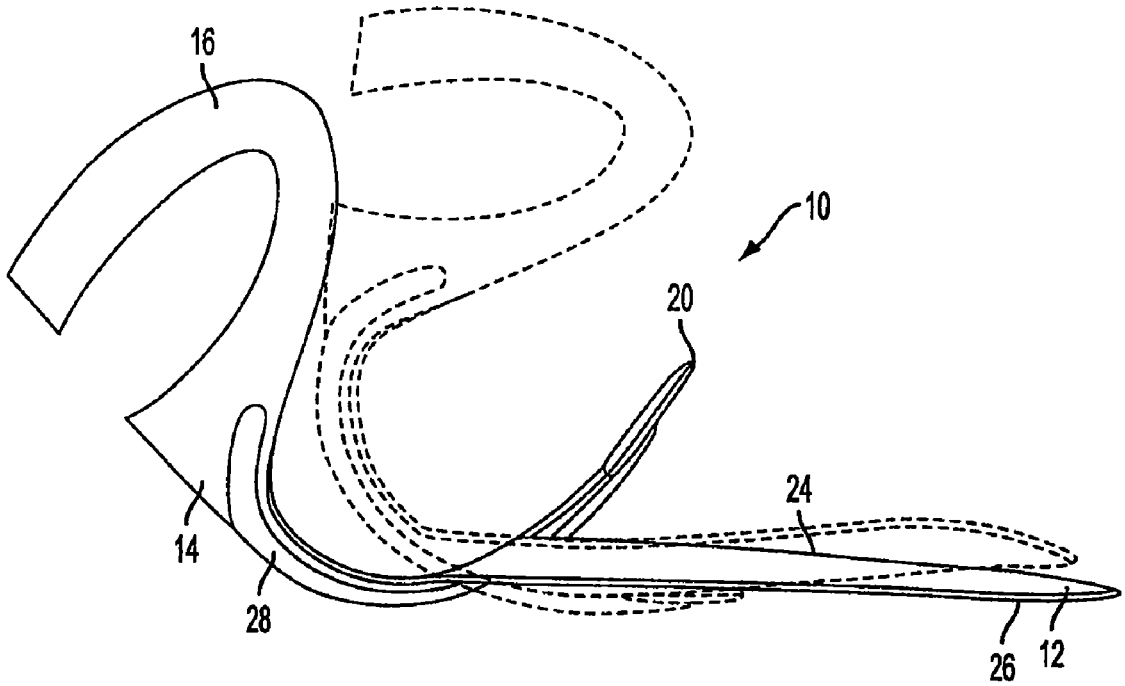

FIGS. 1A and 1B illustrate a first example of an engaging device or element 10 according to this invention. The engaging element 10 includes a bimodal spring member 12 that is movable between at least two stable positions and an arm 14 extending from the bimodal spring 12. As shown in FIGS. 1A and 1B, the bimodal spring member 12 of this example is rounded or oval shaped with an interior hole 22 defined therein, and the arm 14 extends back and behind the bimodal spring member 12, e.g., creating an area for placement of the user's foot (e.g., the user's heel in the illustrated example). The arm 14 further may include a retaining element, such as a heel-capturing member 16 as illustrated in FIGS. 1A and 1B.

An arm/bimodal spring interface area 18 may be provided to translate movement of the bimodal spring member 12 into movement of the arm 14 (and vice versa), as will be explained in more detail below. The interface area 18 may constitute a portion of the spring member 12 located at the position where arm 14 extends from the spring 12. In at least some examples, the arm/bimodal spring interface 18 further may include an extending portion 20 that assists in moving the bimodal spring member 12 between its various stable positions. This extending portion 20, in at least some examples, may extend into and/or above the hole 22 defined in the spring member 12, as illustrated. Another portion 28 of the arm/bimodal spring interface 18 may extend along the arm 14 to reinforce the arm 14 and to help translate movement of the arm 14 to the spring member 12 (and vice versa). This reinforcing portion 28 may constitute a raised plastic rib that supports and reinforces the arm 14. The entire engaging device 10 may be integrally formed from any suitable material, such as plastic.

FIGS. 1A and 1B illustrate a first stable position of the bimodal spring member 12 in solid lines (e.g., the "open position" or the "foot-receiving position" in this example) and a second stable position in broken lines (e.g., the "closed position" or the "foot-engaging position" in this example). In at least some examples, the bimodal spring member 12 will stably maintain either stable position when no external forces are applied to it. When in the open position, the bimodal spring member 12 of this example is arranged so that its inner circumference 24 is oriented higher than its outer circumference 26 with respect to a horizontal base line (i.e., the material of the bimodal spring member 12 slopes outwardly and downwardly from the inner circumference 24 to the outer circumference 26 with respect to a horizontal base line). This orientation of the bimodal spring member 12, through the arm/bimodal spring interface 18, forces the arm 14 outward and backward with respect to the spring member 12, and it forces the extending portion 20 upward.

When changed to the closed position, for example, when a user's foot presses down on the extending portion 20, the bimodal spring member 12 changes its orientation (e.g., it essentially turns inside-out from the open position). More specifically, in the closed position, the bimodal spring member 12 of this example is arranged so that its inner circumference 24 is oriented lower than its outer circumference 26 with respect to a horizontal base line (i.e., the material of the bimodal spring member 12 slopes outwardly and upwardly from the inner circumference 24 to the outer circumference 26 with respect to a horizontal base line). This orientation of the bimodal spring member 12, through the arm/bimodal spring interface 18, forces the arm 14 inward and toward the spring member 12, to a position in which the foot of the user may be engaged by the heel-engaging member 16. If desired, foam rubber or other suitable material may be placed over the heel-capturing portion 16 to improve the feel on the user's foot.

Figure 2:
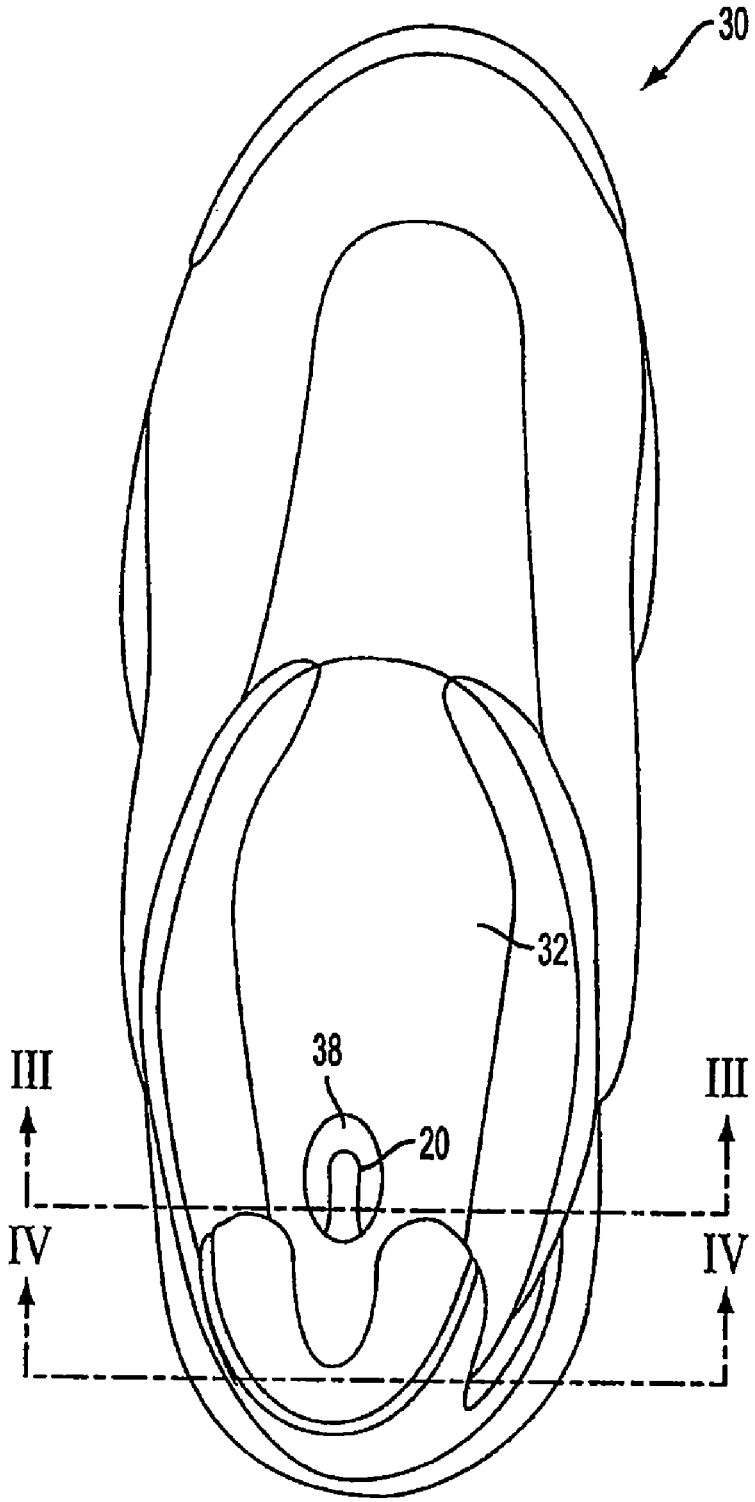
FIG. 2 illustrates an example shoe including the engaging device of FIGS. 1A and 1B.
Figure 3:
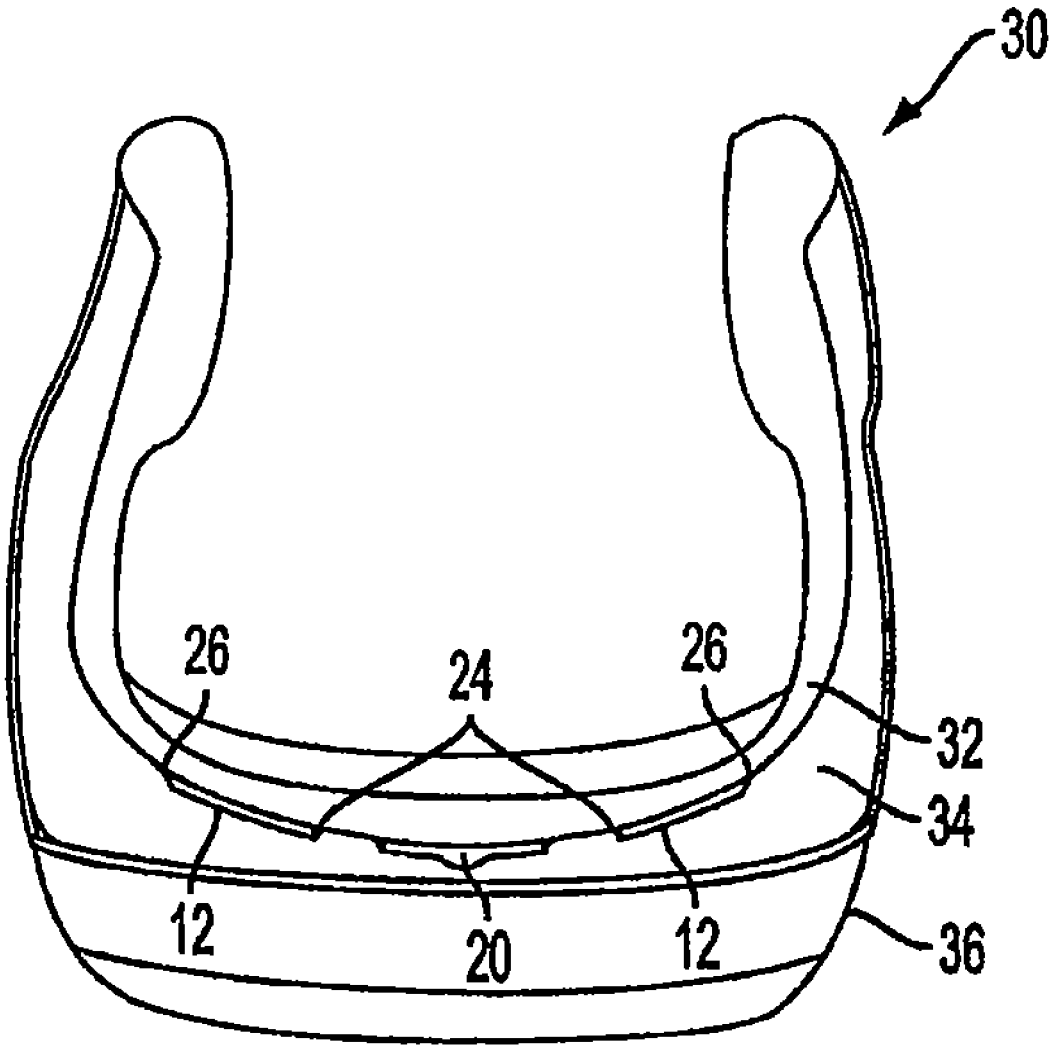
FIG. 3 is a cross-sectional view of the shoe of FIG. 2 taken along line III-III.
Figure 4:
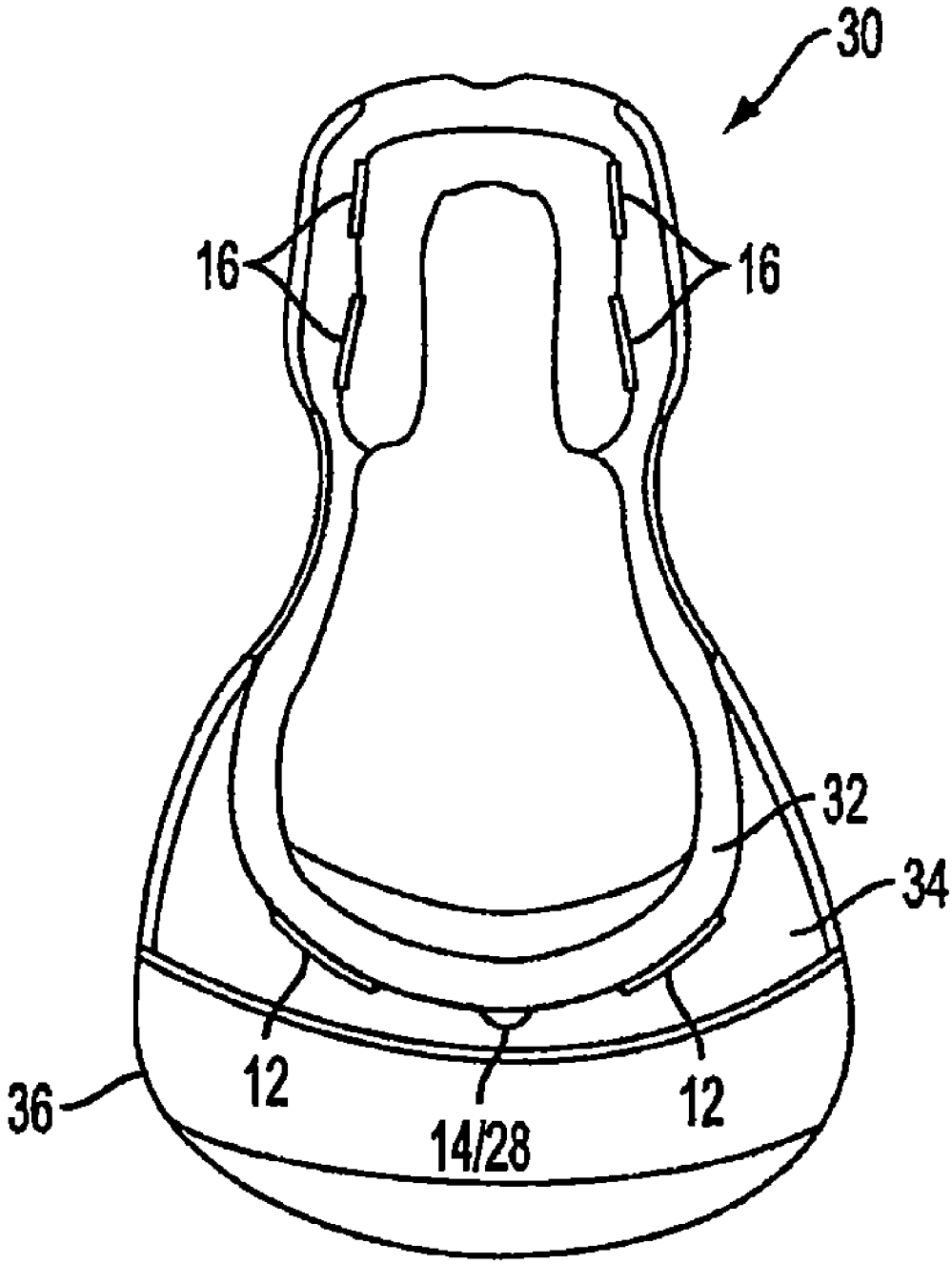
FIG. 4 is a cross-sectional view of the shoe of FIG. 2 taken along line IV-IV.

FIGS. 2-4 illustrate an example shoe 30 as a foot-receiving device that may include the engaging element 10 according to the example of the invention illustrated in FIGS. 1A and 1B. While the engaging element 10 may be the only device for securing a foot-receiving device to the user's foot (as shown in the example of FIG. 2), engaging elements according to examples of this invention also may be used in combination with additional engaging elements according to the invention and/or with other conventional attachment or securing devices, such as shoe laces, buckles, hook and loop fasteners, zippers, and the like, without departing from the invention.

As shown in FIGS. 2-4, the example engaging device 10 of FIGS. 1A and 1B is located at the heel portion of a shoe 30 (or other foot-receiving device) and forms an integral part of the shoe 30 (or other foot-receiving device). As illustrated in FIGS. 3 and 4, the engaging device 10 may be located between an insole or footbed portion 32 of the shoe 30 and a midsole portion 34 of the shoe 30. In fact, if desired, the engaging device 10 may form a portion of the connection between the footbed portion 32 and the midsole portion 34 of the shoe 30. Alternatively, if desired, the engaging device 10 may be located between the midsole portion 34 and an outsole portion 36 of the shoe 30 without departing from the invention (and, indeed, it may form at least a portion of the connection between these portions of the shoe's sole). As still another alternative, the engaging device 10 may be located between and/or form part of a connection between the shoe upper and a midsole or outsole portion of the shoe without departing from the invention. As another alternative, the engaging device 10 may be all or at least partially external to the shoe. Any suitable arrangement of the engaging device 10 with respect to the remainder of the shoe 30 may be used without departing from the invention.

As shown in FIG. 2, if desired, the footbed or insole portion 32 of the shoe 30 may include a hole or opening 38 through which the extending portion 20 of the arm/bimodal spring interface 18 may extend (when an extending portion 20 is present). As another alternative, the material of the footbed or insole portion 32 may cover the extending portion 20 in use (when one is present), but the material of the footbed or insole portion 32 may be pushed upward somewhat when the engaging device 10 is in the open position.

As another alternative, rather than having the extending portion 20 of the arm/bimodal spring interface area 18 extend into the oval or circular interior hole 22 of the bimodal spring member 12 (as illustrated in the figures), the arm/bimodal spring interface area 18 may include an extending portion or a switch element that extends backward and away from the bimodal spring member 12 and its interior hole 22. Optionally, this extending portion or switch element may extend outward from and/or external to the back heel area of the shoe. Advantageously, in at least some examples, this backward extending portion or switch element may be arranged and located such that it can be used to change the bimodal spring member between the closed and open positions (and vice versa) using the other shoe or foot, for example, when the user pushes down on the back of one shoe with the other shoe or the other foot, to force the heel out of the shoe. Of course, this extending portion or switch element also may be activated by the user's hand, the ground, the opposite leg, another person, or the like, without departing from the invention.

Figure 5A:
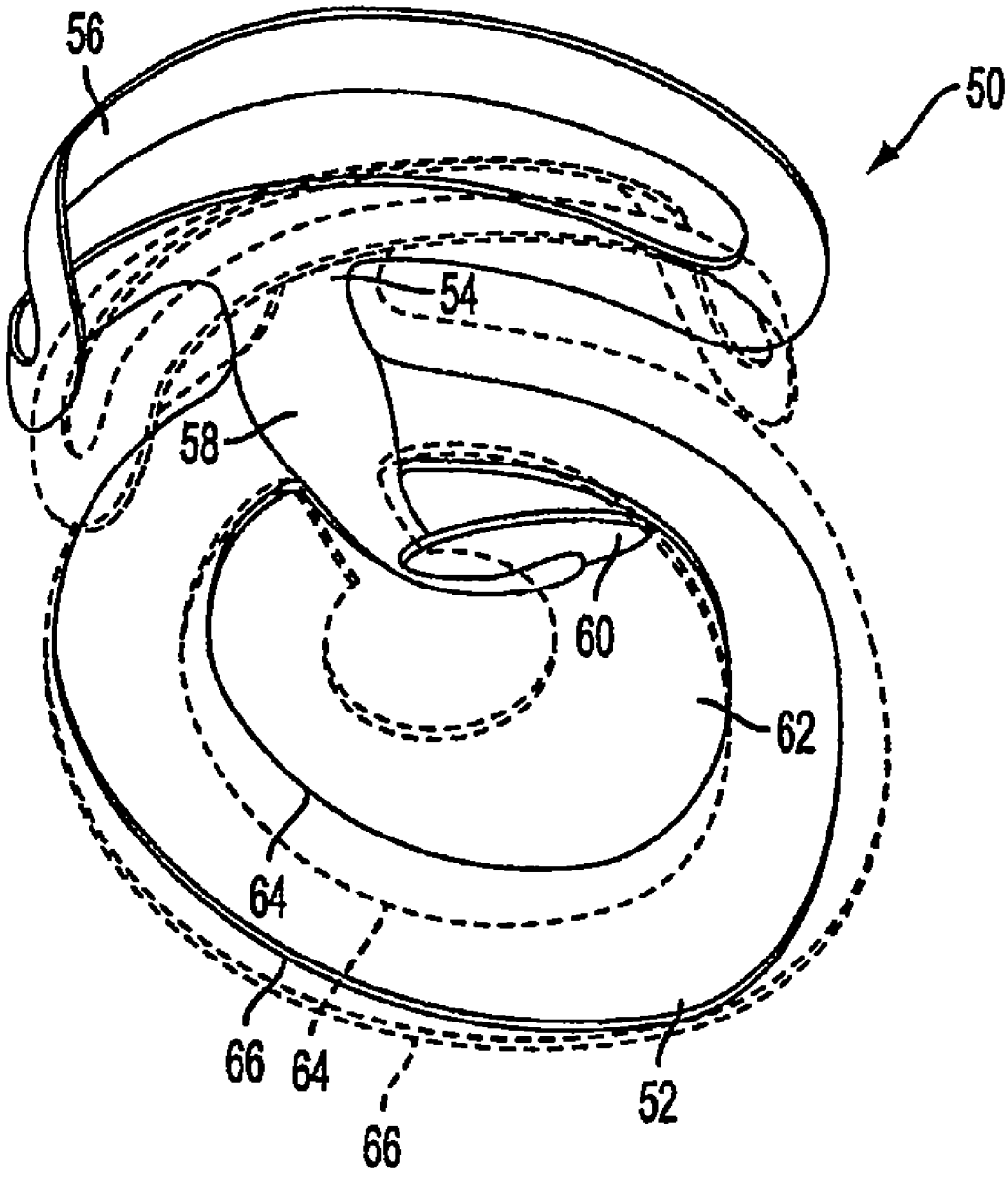
FIGS. 5A and 5B illustrate an example engaging device that engages a toe portion of a user's foot when placed in a foot-receiving device.
Figure 5B:
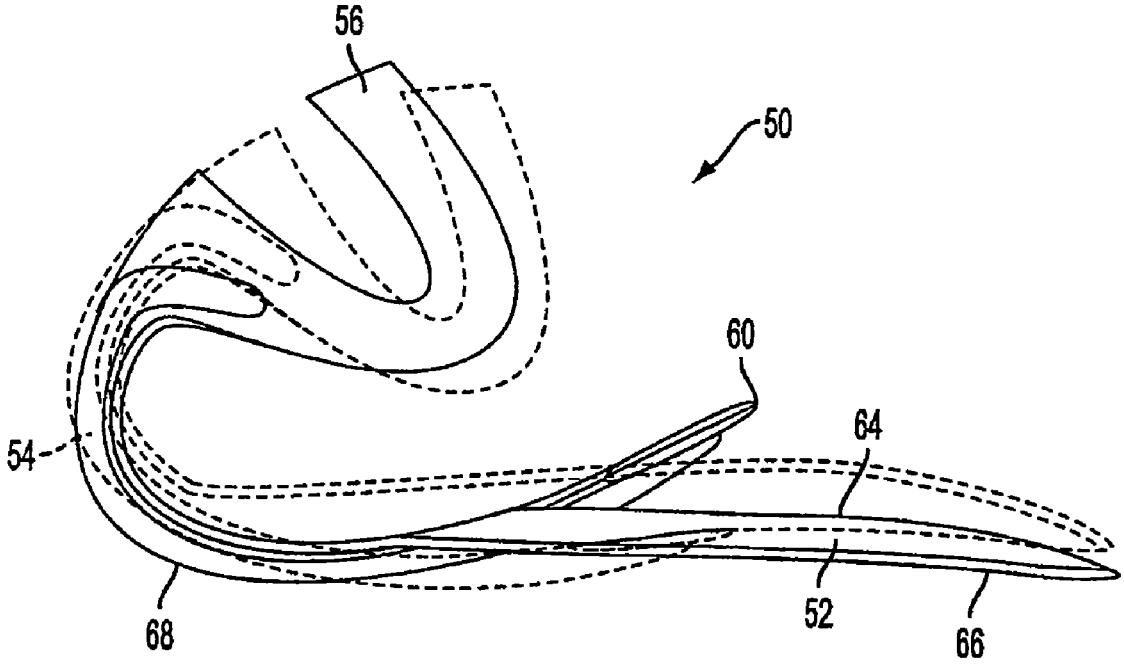

FIGS. 5A and 5B illustrate another example of an engaging device or element 50 according to this invention. The engaging element 50 includes a bimodal spring member 52 that is movable between at least two stable positions and an arm 54 extending from the bimodal spring 52. As shown in FIGS. 5A and 5B, the bimodal spring member 52 of this example is rounded or oval shaped with an interior hole 62 defined therein, and the arm 54 extends forward and in front of the bimodal spring member 52, creating an area for placement of the user's foot (e.g., the user's toes in the illustrated example). The arm 54 further may include a retaining element, such as a toe-capturing member 56 as illustrated in FIGS. 5A and 5B.

An arm/bimodal spring interface area 58 may be provided to translate movement of the bimodal spring member 52 into movement of the arm 54 (and vice versa), as will be explained in more detail below. This interface area 58 may constitute a portion of the spring member 52 located at the position where arm 54 extends from the spring 12. In at least some examples, the arm/bimodal spring interface 58 further may include an extending portion 60 that assists in moving the bimodal spring member 52 between its various stable positions. This extending portion 60, in at least some examples, may extend into and/or above the hole 62 defined in the spring member 52, as illustrated. Another portion 68 of the arm/bimodal interface 58 may extend along the arm 54 to reinforce the arm 54 and to help translate movement of the arm 54 to the spring member 52 (and vice versa). This reinforcing portion 68 may constitute a raised plastic rib that supports and reinforces arm 54. The entire engaging device 50 may be integrally formed from any suitable material, such as plastic.

FIGS. 5A and 5B illustrate a first stable position of the bimodal spring member 52 in solid lines (e.g., the "open position" or the "foot-receiving position" in this example) and a second stable position in broken lines (e.g., the "closed position" or the "foot-engaging position" in this example). In at least some examples, the bimodal spring member 52 will stably maintain either stable position when no external forces are applied to it. When in the open position, the bimodal spring member 52 of this example is arranged so that its inner circumference 64 is oriented higher than its outer circumference 66 with respect to a horizontal base line (i.e., the material of the bimodal spring member 52 slopes outwardly and downwardly from the inner circumference 64 to the outer circumference 66 with respect to a horizontal base line). This orientation of the bimodal spring member 52, through the arm/bimodal spring interface 58, forces the arm 54 outward and forward with respect to the spring member 52, and it forces the extending portion 60 upward.

When changed to the closed position, for example, when a user's foot presses down on the extending portion 60, the bimodal spring member 52 changes its orientation (e.g., it essentially turns inside-out from the open position). More specifically, in the closed position, the bimodal spring member 52 of this example is arranged so that its inner circumference 64 is oriented lower than its outer circumference 66 with respect to a horizontal base line (i.e., the material of the bimodal spring member 52 slopes outwardly and upwardly from the inner circumference 64 to the outer circumference 66 with respect to a horizontal base line). This orientation of the bimodal spring member 52, through the arm/bimodal spring interface 58, forces the arm 54 inward and toward the spring member 52, to a position in which the foot of the user may be engaged by the toe-engaging member 56. If desired, foam rubber or other suitable material may be placed over the toe-capturing portion 56 to improve the feel on the user's foot.

Figure 6:
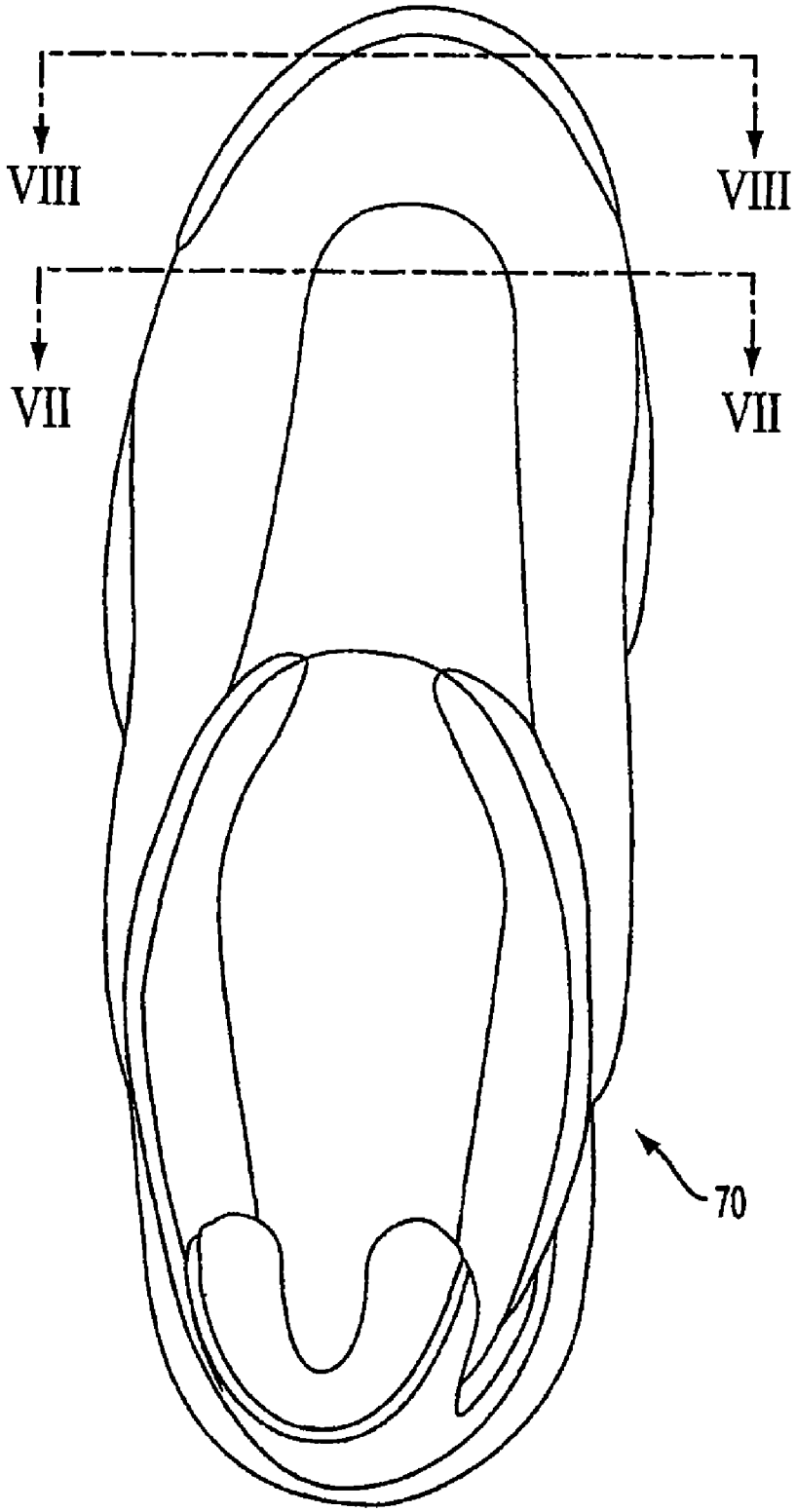
FIG. 6 illustrates an example shoe including the engaging device of FIGS. 5A and 5B.
Figure 7:
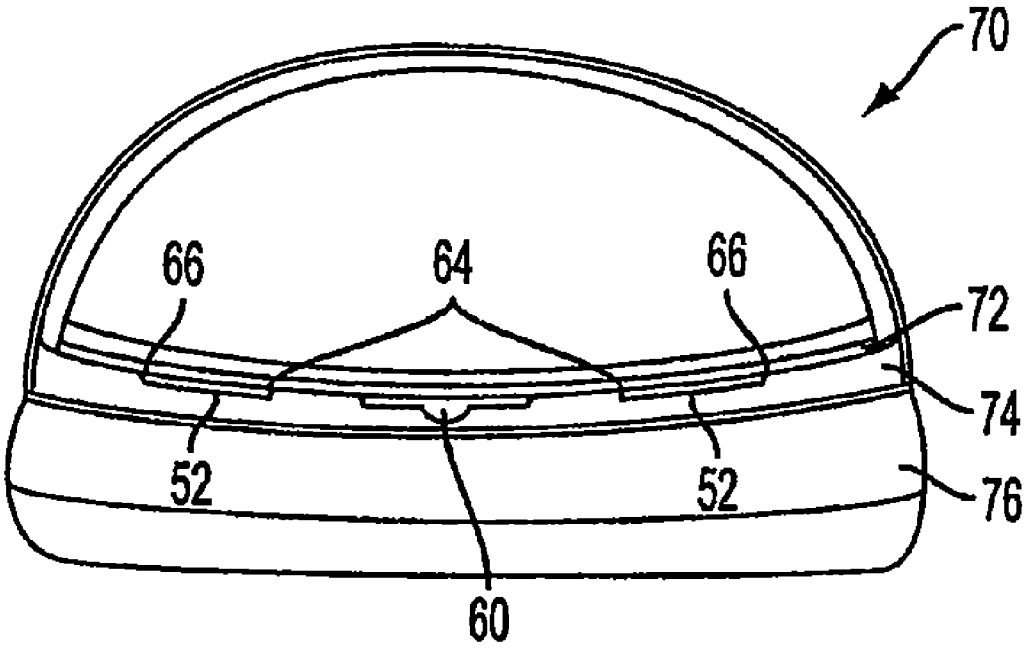
FIG. 7 is a cross-sectional view of the shoe of FIG. 6 taken along line VII-VII.
Figure 8:
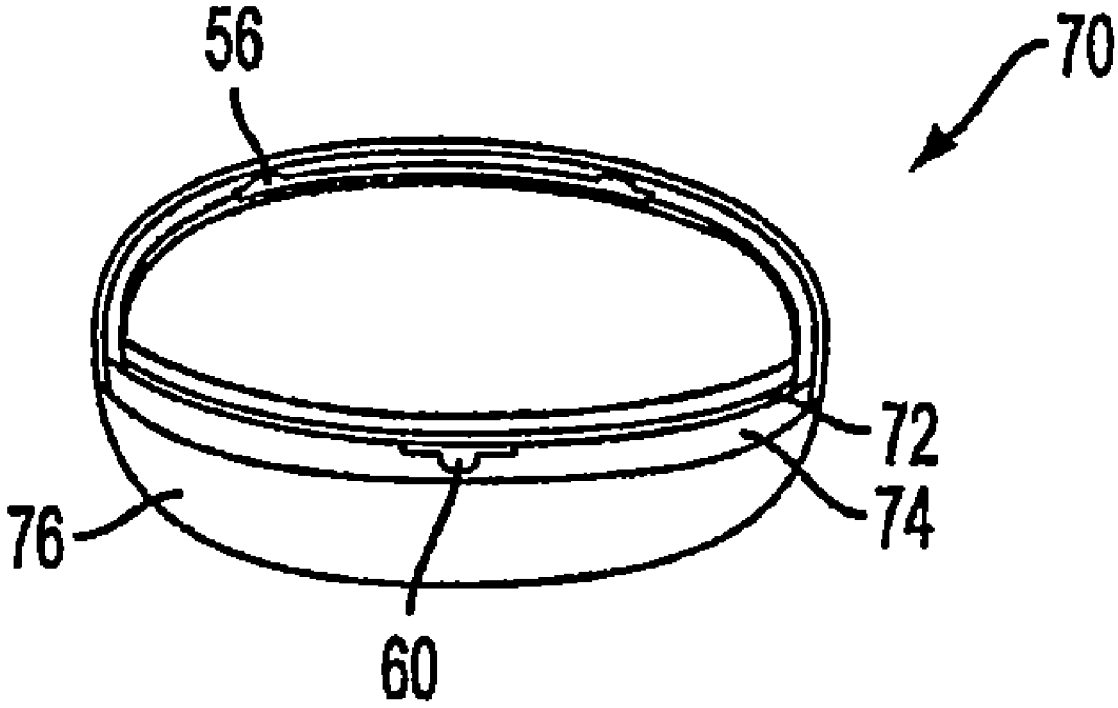
FIG. 8 is a cross-sectional view of the shoe of FIG. 6 taken along line VIII-VIII.

FIGS. 6-8 illustrate an example shoe 70 as a foot-receiving device that may include the engaging element 50 according to the example of the invention illustrated in FIGS. 5A and 5B. The engaging element 50 may be used in combination with additional engaging elements according to the invention and/or with other conventional attachment or securing devices, such as shoe laces, buckles, hook and loop fasteners, zippers, and the like, without departing from the invention.

As shown in FIGS. 6-8, the example engaging device 50 of FIGS. 5A and 5B is located at the toe portion of a shoe 70 (or other foot-receiving device) and forms an integral part of the shoe 70 (or other foot-receiving device). As illustrated in FIGS. 7 and 8, the engaging device 50 may be located between an insole or footbed portion 72 of the shoe 70 and a midsole portion 74 of the shoe 70. In fact, if desired, the engaging device 50 may form a portion of the connection between the footbed portion 72 and the midsole portion 74 of the shoe 70. Alternatively, if desired, the engaging device 50 may be located between the midsole portion 74 and an outsole portion 76 of the shoe 70 without departing from the invention (and, indeed, it may form at least a portion of the connection between these portions of the shoe's sole). As still another alternative, the engaging device 50 may be located between and/or form part of a connection between the shoe upper and a midsole or outsole portion of the shoe without departing from the invention. As another alternative, the engaging device 50 may be all or at least partially external to the shoe. Any suitable arrangement of the engaging device 50 with respect to the remainder of the shoe 70 may be used without departing from the invention.

Although not visible in the figures, if desired, the footbed or insole portion 72 of the shoe 70 may include a hole or opening through which the extending portion 60 of the arm/bimodal spring interface 58 may extend (when an extending portion 60 is present). As another alternative, the material of the footbed or insole portion 72 may cover the extending portion 60 in use (when one is present), but the material of the footbed or insole portion 72 may be pushed upward somewhat when the engaging device 50 is in the open position.

As another alternative, rather than having the extending portion 60 of the arm/bimodal spring interface area 58 extend into the oval or circular interior hole 62 of the bimodal spring member 52 (as illustrated in the figures), the arm/bimodal spring interface area 58 may include an extending portion or a switch element that extends forward and away from the bimodal spring member 52 and its interior hole 62. Optionally, this extending portion or switch element may extend outward from and external to the front toe area of the shoe. Advantageously, in at least some examples, this forward extending portion or switch element may be arranged and located such that it can be used to change the bimodal spring member between the closed and open positions (and vice versa) using the other shoe or foot, for example, when the user pushes down on the front of one shoe with the other shoe or the other foot. Of course, this extending portion or switch element also may be activated by the user's hand, the ground, the opposite leg, another person, or the like, without departing from the invention.

Figure 9A:
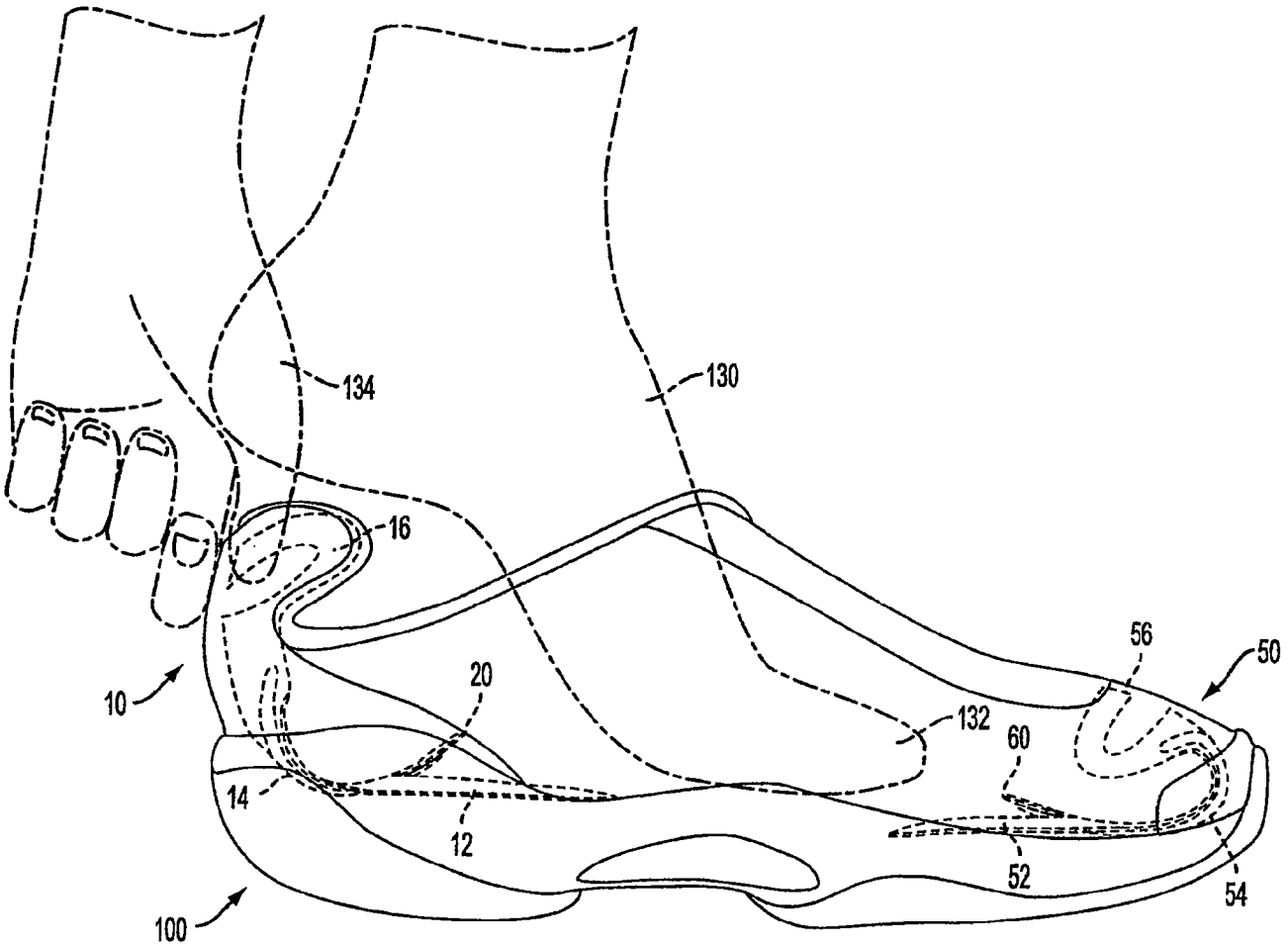
FIGS. 9A through 9C illustrate example steps involved in placing an example shoe according to the invention onto a user's foot.
Figure 9B:
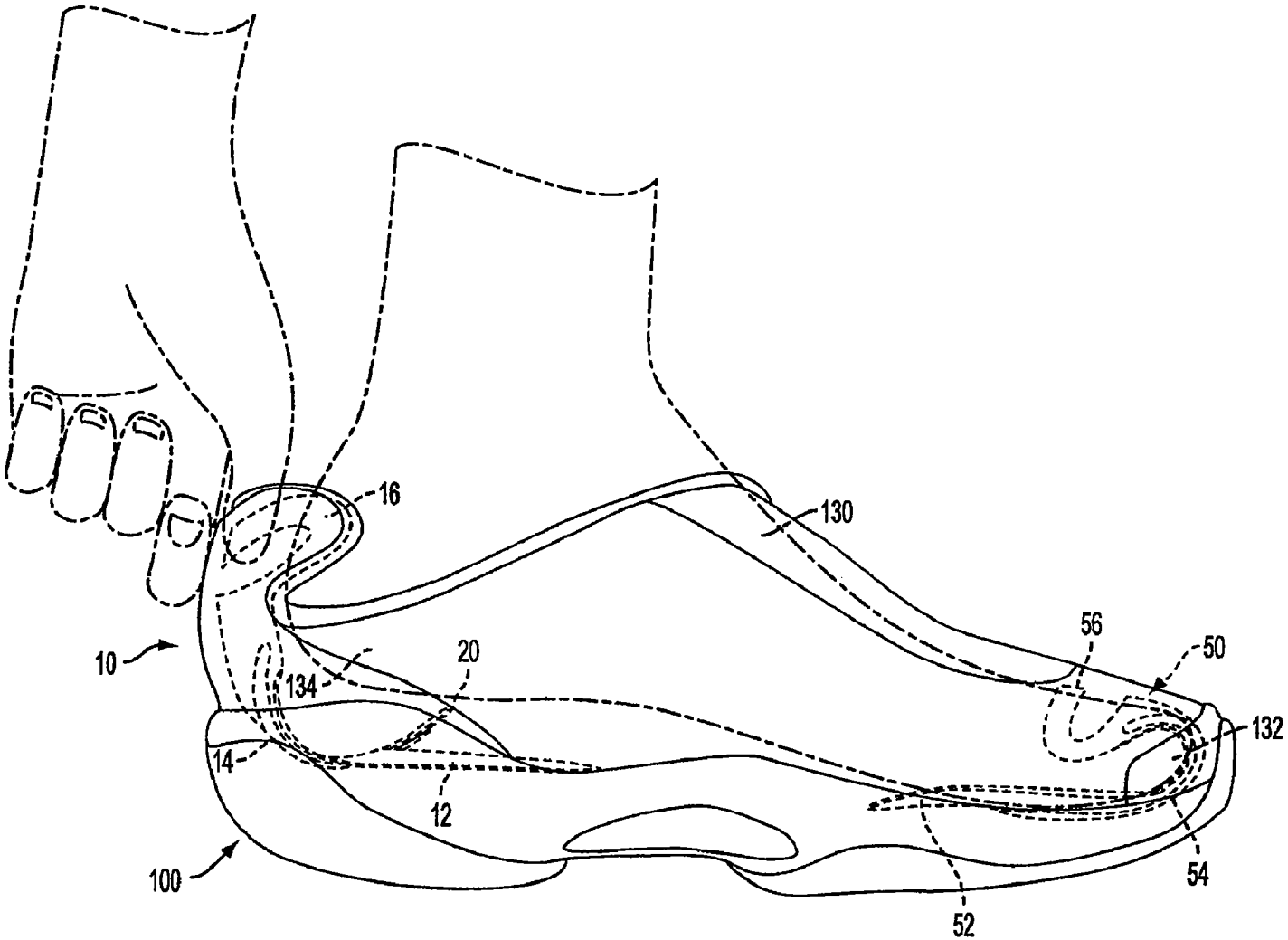
Figure 9C:
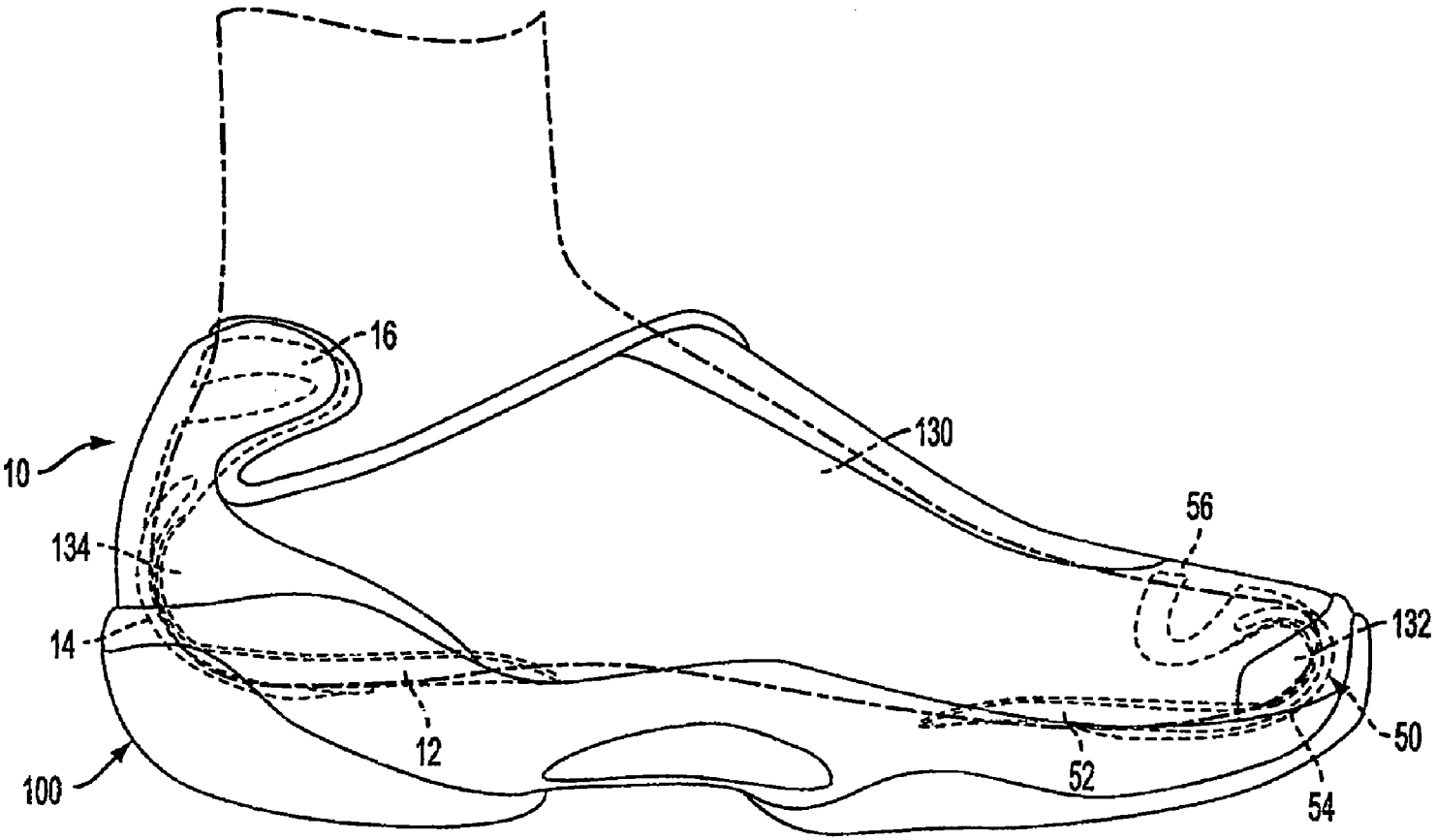

FIGS. 9A through 9C illustrate example steps in using of a foot-receiving device (e.g., a piece of footwear or shoe 100) including example engaging devices 10 and 50 according to the invention. In the illustrated example, the engaging device 10 is located in the heel portion of the shoe 100 (for securing to the heel area of the user) and the engaging device 50 is located in the toe portion of the shoe 100 (for engaging the user's toes).

As shown in FIG. 9A, both engaging devices 10 and 50 are in the open position (or the foot-receiving position) in which the arm portions 14 and 54 extend away from the round or oval-shaped base portions of the spring members 12 and 52. This fact also is evident from FIG. 9A by the extension of extension portions 20 and 60 upward above the plane of the base portions of the spring members 12 and 52. If necessary or desired, the shoe 100 may include features that enable the shoe sides to expand to enable easier movement of the engaging devices 10 and 50 between their open and closed positions. For example, at least some portions of the upper of the shoe 100 may be made from an elastic or otherwise stretchable material to allow the expansion room for the engaging devices 10 and 50 to move to their open position. As another example, the upper of the shoe 100 may include a bellows-like structure or an accordion-like structure to allow for some expansion of the shoe to accommodate the open positions of the engaging devices 10 and 50.

As noted above, FIG. 9A illustrates the shoe 100 with both engaging devices 10 and 50 in the open position as the user begins inserting his/her foot 130 into the shoe 100. As the foot 130 moves forward in the shoe 100, as illustrated in FIG. 9B, the user's toes 132 come to a position in which they encounter the extension portion 60 of the engaging device 50. As the toes 132 move into place in the end of the shoe 100, this action presses the extension portion 60 downward, which in turn, forces the round or oval-shaped spring member 52 to change between its first stable position (the open position) to its second stable position (the closed position), thereby moving the toe-capturing member 56 downward and toward the user's foot 130 to engage the user's toes 132.

At this point in time, as illustrated in FIG. 9B, the user's heel 134 still may be somewhat elevated from the footbed or insole of the shoe 100. Accordingly, the engaging device 10 located in the heel portion of the shoe 100 remains in the open (foot-accepting) position. As the user further steps down into the shoe 100, as illustrated in FIG. 9C, the user's foot 130 forces the extension portion 20 of the engaging device 10 downward, which in turn moves the round or oval-shaped spring member 12 from its first stable position (the open position) to its second stable position (the closed position). This action also forces the heel-capturing member 16 inward, to engage and secure the user's heel 134 in the shoe 100.

To reset the engaging devices 10 and 50 to their open positions, the user need only pull back on the heel-capturing member 16 or toe-capturing member 56 (or their associated arms 14 and 54), which action flips the spring members 12 and 52 inside out (through movement of interface areas 18 and 58) and raises the extension portions 20 and 60 to the positions shown in FIG. 9A. If necessary or desired, the shoe or other foot-receiving devices can provide access holes or mechanisms that will assist the user in flipping the spring members 12 and 52 from their closed position to the open position. This position change may be initiated or occur before the foot is removed from the foot-receiving device, while it is being removed, and/or after it has been removed.

While the example in FIGS. 9A through 9C illustrate use of example engaging devices according to the invention in both the heel and toe portions of a foot-receiving device, those skilled in the art will recognize that a foot-receiving device may include a single engaging device, in either the toe or the heel portions of the foot-receiving device, without departing from this invention. Additionally, the engaging devices according to the invention are not limited for use only in the heel and/or toe portions of a foot-receiving device as shown in FIGS. 9A through 9C. For example, an engaging device according to the invention also may be oriented at any position along the lateral sides of a shoe.

Also, while the example of FIGS. 9A through 9C illustrate the engaging devices according to the invention as the only systems for attaching the foot-receiving device to a user's foot, those skilled in the art will readily understand that engaging devices according to the invention can be used in combination with any other type of system for attaching a foot-receiving device to a user's foot, including conventional attachment systems, such as laces, buckles, straps, hook and loop fasteners, elastic bands, zippers, and the like. Those skilled in the art also will appreciate that the engaging devices according to this invention are not limited to use with footwear, but they can be included as part of any foot-receiving devices without departing from the invention.

Various examples of engaging devices or elements in accordance with this invention have an integral structure in which the spring member, the arm, and the arm/bimodal spring interface are formed from a single piece of plastic or other material (e.g., by injection molding or other suitable manufacturing method). Of course, other structures, including multi-piece structures are possible. For example, the bimodal spring member may include a short arm or other attachment system that will allow attachment of an arm/bimodal spring interface member and/or an arm and/or retaining elements (e.g., attachment via a snapping mechanism or other suitable mechanism). As another example, the arm/ bimodal spring interface member may allow for attachment of various different arms and/or retaining elements (e.g., via a snapping mechanism or other suitable mechanism). In this manner, a single generic bimodal spring or generic bimodal spring/interface member combination may be made and used in combination with a plurality of different interfaces, arms and/or retaining members, depending, for example, on the desired end use of the engaging device, desired shape or properties of the arm and/or retaining member, user height or other characteristics, and the like.

Finally, engaging devices or elements in accordance with examples of this invention are not limited to use with footwear or other foot-receiving devices. Rather, engaging devices or elements in accordance with examples of this invention may be used to engage and/or maintain any types of members together, independently and/or in combination with other engaging or attachment devices.

D. Conclusion

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. An element, comprising:

a bimodal spring member movable between a first stable position and a second stable position, wherein the bimodal spring member includes a ring member having an inner circumference and an outer circumference, wherein the inner circumference defines an opening through the bimodal spring member, and wherein at the first stable position, the inner circumference is oriented higher than the outer circumference with respect to a horizontal base line and at the second stable position, the outer circumference is oriented higher than the inner circumference with respect to the horizontal base line;

an arm extending from the bimodal spring member, wherein the arm moves in response to the bimodal spring member changing between the first stable position and the second stable position; and an arm/bimodal spring interface that induces changes in position of the arm in response to the bimodal spring member changing between the first stable position and the second stable position.

2. An element according to claim 1, wherein the bimodal spring member and the arm form an integral unit.

3. An element according to claim 1, further including:

a retaining element extending from the arm.

4. An element according to claim 3, wherein the retaining element defines a heel-capturing member.

5. An element according to claim 3, wherein the retaining element, the arm, and the bimodal spring member form an integral unit.

6. An element according to claim 1, wherein at least some portion of the arm/bimodal spring interface extends through the opening defined in the bimodal spring member when the bimodal spring member is in the first stable position.

7. An element according to claim 6, wherein the portion of the arm/bimodal spring interface that extends through the opening when the bimodal spring member is in the first stable position does not extend through the opening when the bimodal spring member is in the second stable position.

8. An element according to claim 1, wherein when the bimodal spring member is in the first stable position, the arm is in an open position, and when the bimodal spring member is in the second stable position, the arm is in a closed position.

9. An element according to claim 1, wherein the arm/bimodal spring interface, the arm, and the bimodal spring member form an integral unit.

10. An element according to claim 1, wherein the opening in the bimodal spring member is round or oval shaped.

11. An element according to claim 1, wherein the bimodal spring member stably maintains the first stable position and the second stable position when no external force is applied to the spring member.

12. A piece of footwear, comprising:

a shoe member; and a foot-engaging element engaged with the shoe member, wherein the foot-engaging element includes: (a) a bimodal spring member movable between a first stable position and a second stable position, wherein the bimodal spring member includes a ring member having an inner circumference and an outer circumference, wherein the inner circumference defines an opening through the bimodal spring member, and wherein at the first stable position, the inner circumference is oriented higher than the outer circumference with respect to a horizontal base line and at the second stable position, the outer circumference is oriented higher than the inner circumference with respect to the horizontal base line, (b) an arm extending from the bimodal spring member, wherein the arm moves in response to the bimodal spring member changing between the first stable position and the second stable position, and (c) an arm/bimodal spring interface that induces changes in position of the arm in response to the bimodal spring member changing between the first stable position and the second stable position.

13. A piece of footwear according to claim 12, wherein the foot-engaging element forms an integral unit.

14. A piece of footwear according to claim 12, wherein the foot-engaging element further includes a foot-retaining element extending from the arm.

15. A piece of footwear according to claim 14, wherein the foot-retaining element defines a heel-capturing member.

16. A piece of footwear according to claim 14, wherein the foot-retaining element, the arm, and the bimodal spring member are positioned in the shoe member so as to define a space for receiving a user's toes.

17. A piece of footwear according to claim 12, wherein the foot-engaging element is located at a heel portion of the shoe member.

18. A piece of footwear according to claim 12, wherein the foot-engaging element is located at a toe portion of the shoe member.

19. A piece of footwear according to claim 12, wherein at least some portion of the arm/bimodal spring interface extends through the opening defined in the bimodal spring member when the bimodal spring member is in the first stable position.

20. A piece of footwear according to claim 19, wherein the portion of the arm/bimodal spring interface that extends through the opening when the bimodal spring member is in the first stable position does not extend through the opening when the bimodal spring member is in the second stable position.

21. A piece of footwear according to claim 12, wherein when the bimodal spring member is in the first stable position, the arm is in a foot-receiving position, and when the bimodal spring member is in the second stable position, the arm is in a foot-engaging position.

22. A piece of footwear according to claim 12, wherein the foot-engaging element, at least in part, engages a midsole of the shoe member to a footbed of the shoe member.

23. A piece of footwear according to claim 12, wherein the foot-engaging element, at least in part, engages an outsole of the shoe member to a midsole of the shoe member.

24. A piece of footwear according to claim 12, wherein the opening defined in the bimodal spring member is round or oval shaped.

25. A piece of footwear according to claim 12, wherein the bimodal spring member stably maintains the first stable position and the second stable position when no external force is applied to the spring member.

* * * * *